United States Patent [19]

Aonuma et al.

[11] 3,966,510

[45] June 29, 1976

[54] FERROMAGNETIC POWDER FOR MAGNETIC RECORDING MEDIUM AND METHOD FOR PREPARATION THEREOF

[75] Inventors: Masashi Aonuma; Yasuo Tamai; Goro Akashi, all of Odawara, Japan

[73] Assignee: Fuji Photo Film Co., Ltd., Minami-ashigara, Japan

[22] Filed: Aug. 15, 1974

[21] Appl. No.: 497,794

[30] Foreign Application Priority Data

Aug. 15, 1973 Japan ..... 49-91498

[52] U.S. Cl. ..... 148/105; 75/.5 AA; 148/108

[51] Int. Cl.[2] ..... H01F 1/02

[58] Field of Search ..... 148/31.55, 105, 108; 75/.5 AA; 427/127, 128, 132; 428/423, 425; 29/196.6; 252/62.54

[56] References Cited

UNITED STATES PATENTS

| | | | |
|---|---|---|---|
| 3,206,338 | 9/1965 | Miller et al. | 148/105 |
| 3,567,525 | 3/1971 | Graham et al. | 75/.5 AA |
| 3,702,270 | 11/1972 | Kawasaki et al. | 148/105 |
| 3,756,866 | 9/1973 | Parker et al. | 75/.5 AA |
| 3,837,912 | 9/1974 | Roden | 252/62.54 |
| 3,865,627 | 2/1975 | Roden et al. | 252/62.54 |

*Primary Examiner*—Walter R. Satterfield
*Attorney, Agent, or Firm*—Sughrue, Rothwell, Mion, Zinn & Macpeak

[57] ABSTRACT

A ferromagnetic powder which contains at least Fe—B or Fe—Co—B with the surface of the powder having thereon a layer of Cr or a layer mainly consisting of Cr and a method of preparing the ferromagnetic powder comprising reducing a metal salt capable of forming a ferromagnetic powder containing at least Fe or Fe-Co in an aqueous solution thereof with one or more borohydride compounds or derivatives thereof and after the reduction is initiated adding an aqueous solution containing Cr ion or an anion containing Cr.

19 Claims, No Drawings

FERROMAGNETIC POWDER FOR MAGNETIC RECORDING MEDIUM AND METHOD FOR PREPARATION THEREOF

BACKGROUND OF THE INVENTION

1. Field of the Invention

This invention relates to ferromagnetic powders for a magnetic recording medium and method for preparation thereof, and in particular, to novel ferromagnetic powders and a method for preparation thereof.

2. Description of the Prior Art

Ferromagnetic powders which have heretofore been used in magnetic recording media include $\gamma$—$Fe_2O_3$, Co-containing $\gamma$—$Fe_2O_3$, $Fe_3O_4$, Co-containing $Fe_3O_4$ and $CrO_2$. However, these ferromagnetic powders are not very suitable for magnetic recording of signals of a short recording wavelength (about 10 $\mu$ or less). This is because the magnetic characteristics such as the coercive force (Hc) and the maximum residual magnetic flux density (Br) of these ferromagnetic powders are not sufficient for use in high density recording. Recently, extensive development of ferromagnetic powders having magnetic characteristics suitable for high density recording has been carried out. One substance investigated is a ferromagnetic powder. The powder is made of a metal or a metal alloy. Metals which are mainly used include iron, cobalt and nickel, and other elements such as chromium, manganese, rare earth elements and zinc are optionally added thereto.

The following methods are known for preparation of ferromagnetic powders.

1. A salt of a ferromagnetic metal with an organic acid is pyrolyzed and reduced with a reductive gas, for example, as disclosed in Japanese Patent Publication Nos. 11412/61, 22230/61, 8027/65, 14818/66, 22394/68 and 38417/72, and *Japanese Report of Association of Tohoku University Wire Conversation*, Vol. 33, No. 2, page 57 (1964).

2. A needle-shaped oxyhydroxide, or a derivative thereof containing other metals, or a needle-shaped iron oxide obtained from these oxyhydroxide substances is reduced, for example, as disclosed in Japanese Patent Publication Nos. 3865/65, 20939/64 and 29477/72, German Patent Application (Laid-Open to Public Inspection) No. OLS 2,130,921, British Patent No. 1,192,167 and U.S. Pat. No. 3,681,018.

3. A ferromagnetic metal is evaporated in an inert gas, for example, as disclosed in Japanese Patent Publication No. 27718/72 and Ohyo Butsuri entitled *Applied Physics*, Vol. 40, No. 1, page 110 (1971).

4. A metal carbonyl compound is decomposed, for example, as disclosed in U.S. Pat. Nos. 2,983,997; 3,172,776, 3,200,007 and 3,228,882.

5. A ferromagnetic metal is deposited by electrodeposition using a mercury cathode, and then separated from the mercury, for example, as disclosed in Japanese Patent Publication Nos. 15525/64 and 8123/65, and U.S. Pat. No. 3,156,650.

6. A salt of a ferromagnetic metal is reduced in a solution thereof, for example, as disclosed in Japanese Patent Publication Nos. 20520/63, 26555/63, 20116/68 and 41718/72, U.S. Pat. Nos. 3,567,525; 3,663,318; 3,661,556; 3,669,643; 3,672,867 and 3,756,866, and German Patent Application (Laid-Open to Public Inspection) OLS No. 2,132,430.

This invention is concerned with Method (6) wherein a salt of a ferromagnetic metal is reduced in a solution thereof, and in particular, with a method wherein a borohydride compound or a derivative thereof is used as a reducing agent.

The Method (6) wherein a salt of a ferromagnetic metal is reduced in a solution thereof with a borohydride compound or a derivative thereof has some defects as mentioned below.

In general, the reaction is carried out in a magnetic field to impart a magnetic anisotropy to the reaction system whereby granular particles are linked and shape anisotropy is imparted thereto. However, the linked particles are cleaved during admixture with a binder and dispersion therein, often resulting in a decrease of the shape anisotropy of the particles, a deterioration of the magnetic orientation and a degradation of the squareness ratio (Br/Bs) of the formed magnetic recording tape.

In addition, the powders obtained according to this method are less resistant to moisture, particularly when Fe is included, and are gradually oxidized even at normal temperature, in an extreme case, resulting in a loss of the magnetic character thereof. According to this method, furthermore, since the surface activity of the particles obtained is extremely high, the particles are highly active, which is industrially disadvantageous from the standpoint of their production.

Prior to the present invention various studies have been made to improve the above described defects. For example, U.S. Pat. Nos. 3,535,104, 3,567,525, 3,661,556 and 3,663,318, and Japanese Patent Publication No. 20520/63 disclose a Fe—Co—Ni—B system or a Fe—Co—Ni—P system containing Mn or Cr. Japanese Patent Publication No. 7820/72 discloses the addition of Mn, Cu or Ag to a Fe—Co—Ni—B system. U.S. Pat. No. 3,206,338 discloses a Fe—Co—B system containing Cr. U.S. Pat. Nos. 3,669,643, 3,672,867 and 3,756,866 disclose a Co—P system or a Co—B system containing Cr, Zn, Pt, As, Ca, Ge or Japanese Patent Publication No. 20116/68 suggests a method for saponification of the surface of metal powders with higher fatty acids.

Further, the addition of Cr is already known, as disclosed in Japanese Patent Publication No. 20520/68. In the conventional method, however, wherein Cr is previously added to the reaction bath to prepare ferromagnetic powders, the Cr added is substantially uniformly distributed in the formed powders and the product is prepared in the form of an alloy, solid solution or the like. The coercive force of the formed ferromagnetic powders decreases as the content of the Cr therein increases, and thus it was impossible to make the best use of the essential characteristics of the ferromagnetic powders.

SUMMARY OF THE INVENTION

Accordingly, an object of this invention is to overcome the defects in the prior art.

More precisely, an object of this invention is to provide ferromagnetic powders having improved magnetic characteristics.

Another object is to provide moisture-proof and difficulty oxidizable ferromagnetic powders.

Still another object is to provide ferromagnetic powders which are relatively stable during manufacture and therefore can easily be prepared.

Therefore, this invention provides ferromagnetic powders for magnetic recording media which contain at least Fe—B or Fe—Co—B and the surface part of which is coated with Cr or a layer mainly of Cr, as well as a method for the preparation of these ferromagnetic powders comprising reducing a metal salt capable of forming a ferromagnetic powder containing at least Fe or Fe—Co in an aqueous solution thereof with one or more borohydride compounds or derivatives thereof and after the reduction is initiated adding an aqueous solution containing Cr ion or a Cr-containing anion to the reaction solution.

DETAILED DESCRIPTION OF THE INVENTION

The ferromagnetic powders of this invention comprise ferromagnetic powders having a layer of Cr or a layer mainly of Cr on the surface or the powders.

It has been found that the provision of Cr on the surface of the magnetic powders according to the present invention causes a marked improvement in the oxidation resistance of the powders and in prevention of the deterioration of the magnetic characteristics thereof, particularly the decrease of the coercive force thereof. It has also been found that the ferromagnetic powders of the present invention have improved admixture properties and dispersability with a binder.

Thus, this invention provides ferromagnetic powders of novel structure and a method for preparation thereof.

The ferromagnetic powders of this invention include at least Fe and B and optionally can include at least one ferromagnetic metal such as Co and Ni or rare earth elements, Cr, Mn, Sn, Zn, Al, Cu, W, Ag, Pd, Pb, Ti, etc. Suitable compositions of the ferromagnetic powders which can be used in the invention include Fe—B, Fe—Co—B, Fe—Ni—B, Fe—Co—Ni—B, Fe—B—Cr, Fe—Co—Ni—B—Cr, Fe—Co—B—Mn, Fe—Ni—B—Mn, Fe—Co—Ni—B—Zn, Fe—Co—B—Al, Fe—Ni—B—Cu, Fe—Co—B—W, Fe—Co—B—Ag, Fe—Ni—B—Pd, Fe—Co—Ni—B—Pb, Fe—B—Ti, etc. A suitable amount of these elements other than Fe and Co can range from about 0.01 to 10 atomic percent based on the sum of the amount of Fe or Fe and Co being 100 atomic percent. The surface of the powders which are optionally selected from the above mentioned elements is coated with a layer of Cr or a layer mainly consisting of Cr. The amount of Cr coated on the surface of the powders is not specifically limitative, and a mono-atomic or thicker layer is sufficient for attaining the effects of the present invention. However, if the coating layer is too thick, the essential characteristics of the magnetic substance are degraded thereby, for example, the Bs value thereof per unit volume is reduced due to the increase in the thickness of the non-magnetic layer. Thus, the thickness of the Cr-coating layer is suitably about 0.1 $\mu$ or less, preferably 300 A or less. Preferably the Cr-coating surface layer contains at least 1% by weight of Cr.

Ferromagnetic powders of the present invention containing at least Fe and B and coated with a Cr-layer have particularly excellent oxidation resistance. In addition, these powders can easily be dealt with in the manufacture process thereof due to their low self-combustibility. Moreover, these powders have excellent magnetic characteristics and excellent admixture properties and dispersability with a binder, and a magnetic recording tape produced using these powders has a good magnetic orientation and a high squareness ratio (Br/Bs).

In the present invention, the term "salts of metals containing at least Fe or Fe—Co and being capable of forming ferromagnetic powders" designates those containing any of Fe, Co, Fe—Co, Fe—Ni, Co—Ni and Fe—Co—Ni, and optionally containing an appropriate amount of salts of rare earth elements such as La, Ce, Nd and Sm, and other elements such as Sn, Al, W, Cr, Mn, Cu, Zn, Ag, Pb, Pd and Ti for the purpose of improving the magnetic characteristics and anti-oxidation stability. For example, the sulfates, chlorides, sulfides, nitrates, formates, acetates, pyrophosphates and sulfamates of these elements are suitable.

One or more borohydride compounds such as sodium borohydride, potassium borohydride, borane, borazane, borohydride, dimethylaminoborane, diethylaminoborane, etc. or derivatives thereof are added in performance of the chemical oxidation-reduction reaction according to the present invention. These compounds can be used alone or in combination.

Representative examples of Cr-compounds which can be added to the reaction bath of the present invention are potassium chromium sulfate (chromium alum), chromium nitrate, chromium acetate, chromium chloride, chromic anhydride, dichromates, chromium sulfate and ammonium chromium sulfate. These chromium compounds are added to the reaction bath after initiation of the reaction, and in particular, it is preferable to add the compound in the presence of hydrogen gas generated after initiation of the reaction.

In addition, it is to be noted that the addition of the chromium compound before initiation of the reaction is ineffective to achieve the objects of the invention.

The amount of chromium to be added to the reaction bath preferably ranges from about 0.001 to 0.5 mole per 1 mole of metal ion in the reaction bath.

The reaction solution can include, if desired, in addition to the above-described components, a complex forming agent or a pH buffer, for example, monocarboxylic acids such as formic acid, acetic acid, propionic acid, butyric acid, valeric acid, acrylic acid, trimethylacetic acid, benzoic acid and chloroacetic acid and the salts thereof; dicarboxylic acids such as oxalic acid, succinic acid, malonic acid, maleic acid, itaconic acid and p-phthalic acid and the salts thereof; and oxycarboxylic acids such as glycolic acid, lactic acid, salicylic acid, tartaric acid, and citric acid and the salts thereof. In addition, boric acid, carbonic acid, sulfurous acid, hydrochloric acid, sulfuric acid, phosphoric acid, nitric acid, ammonium hydroxide, alkali metal hydroxides, etc., can be used in the reaction solution as a pH adjusting agent or a pH buffer. In addition, organic solvents, etc. can be added, if desired, to the reaction bath.

Further, to the reaction solution there can be added as desired a soluble protein together with a proteolytic enzyme, a carbohydrate together with a carbohydrate decomposer, and an organic solvent.

Suitable soluble proteins include simple proteins which decompose into chiefly amino acids upon hydrolysis, conjugated proteins comprising polypeptide chains connected to other compounds, derived proteins which have been modified by various physical, thermal, photochemical or chemical procedures, etc. They are all composed of macromolecules of polypeptides, comprising amino acids, having a molecular weight of from about 10,000 to about 5,000,000.

Simple proteins suited for the present invention include albumins such as egg albumin, blood serum albumin, lactoalbumin, etc., globulins such as serum globulin, lactoglobulin, myosin, edestin, ammandin, legumin, etc., glutelins such as glutenin, hordenin, oryzenin, etc., prolamins such as gliadin, hordein, zein, etc., albuminoids such as collagen, elastin, keratin, fibroin, etc., histones such as thymus-histone, liver-histone, scombrone, etc., and protamines such as salmine, clupeine, strurine, iridine, etc.

Conjugated proteins include chromoproteins, phosphoproteins, metalloproteins, lipoproteins, glycoproteins, nucleoproteins, etc. Examples of chromoproteins are hemoproteins such as hemoglobin, myoglobin, cytochrome, catalase, peroxydaze, etc., chlorophyll proteins such as chlorophylin; carotinoid proteins such as rhodopsin, etc., flavoproteins such as flavin mononucleotide, flavin adeninedinucleotide, etc. Phosphoproteins include casein, hyderin, apoferritin, etc. Metalloproteins include iron proteins such as ferritin, apoferritin, etc., copper proteins such as hemocyanine, etc., zinc proteins; manganese proteins, etc. Lipoproteins include thrombplastein, $\alpha_1$-lipoprotein, $\alpha_2$-lipoprotein, lipobilitein, lipotenilin, etc., glucoproteins include mucin, celluloplasmin, siderophilin, fibrin, prothrombin collagen, enterokinase, haptoglobin, mucoid, etc., and nucleoproteins include nucleic acids, deoxypentose-nucleoprotein, pentose-nucleoprotein, viruses, bacteriophages, etc.

Derived proteins include gelatin modified protein, proteans, proteoses, peptones, polypeptides, metaproteins, etc.

These proteins can be used individually or in combination.

To decompose any of these proteins, proteases belonging to the hydrolase type, can be employed, including pepsin, trypsin, chymotrypsin, cathepsin, rennin, papain, promelin, ficin, thrombin, enteropeptidase, plasmin, mold protease, yeast protease, bacterium protease, etc. Such proteolytic enzymes can be used individually or in combination.

Carbohydrates comprise monosaccharides, oligosaccharides such as di-, tri- or tetrasaccharides and polysaccharides.

Monosaccharides includes polyhydric alcohols containing aldehyde groups (aldoses) and those containing keto groups (ketoses).

Oligosaccharides comprise dimers, trimers or tetramers of monosaccharides, each of which may be common or different, through glycoside linkages. Polysaccharides are polymers of mono- or oligosaccharides.

Suitable monosaccharides include glycol aldehydes which is the aldose of a diose ($C_2H_4O_2$), a triose ($C_3H_6O_3$) such a glyceraldehyde (aldose) or dihydroxyacetone (ketose), etc. a tetrose ($C_4H_8O_4$) such as erythrose (aldose), erythrulose (ketose), etc., a pentose ($C_5H_{10}O_5$) such as ribose, xylose, arabinose (aldose), arabinulose (ketose), xylulose (ketose), etc. a hexose ($C_6H_{12}O_6$) such as D-glucose, mannose, galactose, (aldose), D-fructose, sorbose (ketose), and a heptose ($C_7H_{14}O_7$) such as mannoheptose, which is an aldose, or heptulose which is a ketose.

Oligosaccharides, include disaccharides such as lactose (comprising D-glucose and D-galactose), maltose (comprising two moles of D-glucose), sucrose (comprising D-glucose and D-fructose), trehalose (comprising D-glucose); trisaccharides such as raffinose (comprising D-glucose, D-fructose and D-galactose), gentianose (comprising D-fructose and two molecules of D-glucose), mannotriose (the trimer of mannose), etc; and tetrasaccharides such as stachyose (comprising two molecules of D-galactose, D-glucose and D-fructose), etc.

Polysaccharides which can be used for the present invention include dextrin (D-glucose), starch (D-glucose), glycogen (D-glucose), cellulose (D-glucose), inulin (fructose), mannan (mannose), araban (arabinose), xylan (xylose), dextran (D-glucose), galactan (galactose), gum arabic (comprising galactose, glucuronic acid, hexose and methylpentose), etc.

As is clear from the above explanations, suitable carbohydrates for the present invention are monosaccharides and polysaccharides comprising a multiplicity of monosaccharides connected by glycoside linkages. Further, as the enzyme to decompose such a carbohydrate, a hydrolase such as $\alpha$-amylase (diastase), $\beta$-amylase (diastase), cellulase, lichenase, laminarinase, inulase, $\alpha$-glucosidase, $\beta$-glucosidase, $\alpha$-galactosidase, $\beta$-mannosidase, etc., all of which are glycosidases, can be used.

An inorganic acid such as hydrogen chloride, sulfuric acid, nitric acid, etc. can also be used to decompose carbohydrates.

Use of ultrasonic waves in the reaction is effective to improve the characteristics of the resulting ferromagnetic powders. Thus, a reaction bath of optionally selected components is subjected to a chemical oxidation-reduction reaction optionally in a magnetic field of several ten of oersteds or more, thereby to prepare the ferromagnetic powders.

The reaction condition in the method of the present invention is not specifically limited, and the effective range of the reaction pressure is preferably about 0.5 to 5 atms. The reaction temperature is preferably about 65°C or below, e.g., about −10°C up to about 65°C, and the pH of the reaction solution is preferably about 12 or less. The magnetic field is effectively several tens of oersteds or more, and the stronger the magnetic field the better. The magnetic field preferably ranges from about 500 to 3,000 Oe.

The metal ion concentration including the chromium desirably ranges from about 0.002 to 2 moles/liter, preferably 0.01 to 0.05 mole/liter.

The concentration of the borohydride compound or a derivative thereof used as the reducing agent desirably ranges from about 0.0002 to 10 moles/liter, and the molar ratio of the reducing agent/metal ion desirably ranges from about 0.1 to 5.

Suitable solvents which can be employed for the borohydride compound or derivative thereof include water, ammonia or a mixture of water and a polar organic solvent (in which the amount of the polar organic solvent present is less than about 50% by weight). Examples of polar organic solvents are amines such as methylamine, ethylamine, iso-propylamine, n-propylamine, etc., alcohols such as methanol, ethanol, tetrafurfuryl alcohol, etc., dimethylformamide, dimethylsulfoxide; and the like.

Observation has revealed that the ferromagnetic powders obtained in the method of this invention as described above are granular, each having a particle size of about 300 to 5,000 A in length and about 150 to 500 A in width, and that several or several tens or more of the respective particles are linked together to form a string-like, rod-like or necklace-like form. The particles obtained have an Hc of about 10 to 2,000 Oe and a Bm of about 8,000 gauss or more. These ferromagnetic powders obtained in the method of the present invention contain a larger proportion of Cr in the surface part of the respective particle, and Cr exists in the form of Cr-metal per se, Cr-oxide, Cr-hydroxide, Cralloy, or Cr-solid solution. Analysis of these ferromagnetic particles clarified that a large amount of Cr is contained in the surface of the particle. The analysis was carried out as follows. The powders were dissolved in a hydrochloric acid solution and analyzed with the lapse of time. As a result, it was clarified that conventional specimens containing Cr at random in the powder uniformly release Cr in the solution irrespective of time, while the samples of the present invention release a large amount of Cr in the solution in the initial stage of dissolution and the amount of released Cr abruptly decreases with the lapse of time. The presence of Cr in the surface of the respective particles of the ferromagnetic powders of the present invention can be presumed also from the result of the magnetic chracteristics and oxidation resistance of these substances.

It is effective to heat the ferromagnetic powders obtained in the present invention in a non-oxidizing atmosphere or in the presence of a slight amount of $H_2O$ or $O_2$, for the purpose of improving the effect of the present invention. A suitable heating temperature ranges from about 60° to 550°C for about 30 minutes to 120 hours. Suitable non-oxidizing atmospheres include inert gases such as nitrogen, helium, neon, argon, krypton, xenon or radon and reducing gases such as hydrogen, carbon monoxide, carbon dioxide or mixtures therof. When the ferromagnetic powder is heated in a slight amount of $H_2O$ a relative humidity of less than about 10 % is suitable and when heated in the presence of a small amount of $O_2$, a suitable concentration of $O_2$ is less than 50 mm Hg, preferably less than 20 mm Hg.

The ferromagnetic powders of the present invention can be used for the production of magnetic recording media, by dispersion with a binder, coating on a support and drying thereon.

Binders which can be used together with the ferromagnetic powders of the present invention include, conventional thermoplastic resins and thermosetting resins. These resins can be used in the form of a mixture thereof.

Thermoplastic resins are those having a softening point of about 150°C or below, an average molecular weight of about 10,000 to 200,000, and a degree of polymerization of about 200 to 1,000 or so, and representative examples thereof include vinyl chloride-vinyl acetate copolymers, vinyl chloride-vinylidene chloride copolymers, vinyl chloride-acrylonitrile copolymers, acrylate-acrylonitrile copolymers, acrylate-vinylidene chloride copolymers, acrylate-styrene copolymers, methacrylate-acrylonitrile copolymers, methacrylate-vinylidene chloride copolymers, methacrylate-styrene copolymers, urethane elastomers, polyvinyl fluorides, vinylidene chloride-acrylonitrile copolymers, butadiene-acrylonitrile copolymers, polyamide resins, polyvinyl butyral resins, cellulose derivatives, styrene-butadiene copolymers, polyester resins, chlorovinylether-acrylate copolymers, amino resins and various kinds of synthetic rubber type thermoplastic resins. These resins can be used in the form of a mixture thereof. Examples of these resins are disclosed in Japanese Patent Publication Nos. 6877/62, 12528/64, 19282/64, 5349/65, 20907/65, 9463/66, 14059/66, 16985/66, 6428/67, 11621/67, 4623/68, 15206/68, 2889/69, 17947/69, 18232/69, 14020/70, 14500/70, 18573/72, 22063/72, 22064/72, 22068/72, 22069/72, 22070/72, and 27886/72, and U.S. Pat. Nos. 3,144,352; 3,419,120; 3,499,789 and 3,713,887.

Thermosetting resins are those having a molecular weight of about 200,000 or less in the form of a coating solution, and when heated, after being coated and dried, the molecular weight thereof becomes infinitely high due to condensation or addition reactions. Of these resins, those which neither soften nor melt before the resin is pyrolyzed are preferred. Examples of preferred resins include phenol resins, epoxy resins, polyurethane setting resins, urea resins, melamine resins, alkyd resins, silicone resins, reactive acrylic resins, epoxy-polyamide resins, nitro cellulose-melamine resins, mixtures of high molecular weight polyester resins and isocyanate prepolymers, mixtures of methacrylate copolymers and diisocyanate prepolymers, mixtures of polyester-polyols and polyisocyanates, urea-formaldehyde resins, mixtures of low molecular weight glycols/-high molecular weight diols/ triphenylmethane-triisocyanates, polyamine resins and mixtures thereof.

Examples of these resins are disclosed in Japanese Patent Publication Nos. 8103/64, 9779/65, 7192/66, 8016/66, 14275/66, 18179/67, 12081/68 28023/69, 14501/70, 24902/70, 13103/71, 22065/72, 22066/72, 22067/72, 22072/72, 22073/72, 28045/72, 28048/72 and 28922/72, and U.S. Pat. Nos. 3,144,353; 3,320,090; 3,437,510; 3,597,273; 3,781,210 and 3,781,211.

The proportion of the above described thermosetting resin binder or thermoplastic resin binder to the ferromagnetic powder of the present invention is suitably about 30 to 300 parts by weight, preferably 50 to 150 parts of weight, of the resin binder to 300 parts by weight of the ferromagnetic powder, calculated in terms of the composition of the finally formed film. In this case, the thickness of the dry film of the formed magnetic recording layer is in the range of about 1 to 10 $\mu$.

Formation of the magnetic recording layer can be carried out by dissolving the above described components in an organic solvent and coating the resulting coating solution on a support. The thickness of the support is suitably about 5 to 50 $\mu$ or so, preferably 10 to 40 $\mu$ or so, and examples of the support are polyesters such as polyethylene terephthalate, polyolefins such as polypropylene, cellulose derivatives such as cellulose triacetate or cellulose diacetate and polycarbonates.

Coating of the above-described magnetic recording layer on a support can be carried out by various means such as air-doctor coating, blade coating, air-knife coating, squeeze coating, dip coating, reverse-roll coating, transfer-roll coating, gravure coating, kiss coating, cast coating and spray coating, and other means can also be utilized therefor. These coating methods are described in detail in a Japanese reference entitled *Coating Engineering* (pp.253–277) published by Asakura Publishing Co. Mar. 20, 1972.

Representative examples of organic solvents which can be used in coating the magnetic recording layer on a support are ketones such as acetone, methyl ethyl ketone, methyl isobutyl ketone and cyclohexanone; alcohols such as methanol, ethanol, propanol and butanol; esters such as methyl acetate, ethyl acetate, butyl acetate, ethyl lactate, glycol acetate monoethylether; ethers and glycol ethers such as diethyl ether, glycol-dimethylether, glycolmonoethylether and dioxane; aromatic hydrocarbons such as benzene, toluene, and xylene; and chlorinated hydrocarbons such as methylene chloride, ethylene chloride, carbon tetrachloride, chloroform, ethylene-chlorohydrin and dichlorobenzene.

The present invention will be explained in greater detail by reference to the following Examples and Comparative Examples. One skilled in the art can easily understand that the components, proportions and operational procedures as shown herein can be varied so far as these do not overstep the inventive idea of the present invention. Accordingly, this invention is not to be construed as being limited to only the illustrated Examples. All parts and percents are by weight unless otherwise specifically indicated.

EXAMPLE 1

| | | Mol/Liter |
|---|---|---|
| Solution M | Ferrous Chloride | 0.45 |
| | Cobalt Chloride | 0.05 |
| Solution R: | Sodium Borohydride | 1.0 |
| Solution A: | Potassium Chromium Sulfate | 0.2 |

100 parts (by volume) of the above solution M were put in a non-magnetic container, a direct current magnetic field of 1,000 Oe was imparted to the entire container, and 100 parts of the above Solution R were added thereto over the course of 10 seconds while slowly stirring, to start the reaction. After 2 seconds, 25 parts of Solution A were added to the reaction system over the course of 5 seconds to further carry out the reaction, and the reaction was completed after 15 minutes. After being fully washed with water, the ferromagnetic powder obtained was mixed with acetone to facilitate water removal and dried in an air drier at 60°C to obtain a ferromagnetic powder. The thus obtained powder was designated Sample No. P-1. Next, a composition of the following ingredients including the powder obtained was put in a ball mill and admixed and dispersed therein to obtain a magnetic coating composition.

| | Parts |
|---|---|
| Ferromagnetic Powder | 300 |
| Polyester-polyol | 40 |
| Polyisocyanate Compound | 20 |
| Nitrocelulose | 20 |
| Aluminum Oxide (particle size: 0.3 $\mu$ diameter) | 5 |
| Lecithin | 3 |
| Methyl Ethyl Ketone | 450 |
| Methyl Isobutyl Ketone | 400 |

The coating composition was applied to one surface of a polyethylene terephthalate film (thickness: 25 $\mu$) in a magnetic field and heated and dried to form a layer having a thickness of 5 $\mu$. The thus obtained magnetic web of a broad width was treated with a super calender and slit to form a video tape having a width of one-half inch. The surface character of the tape obtained was extremely good. This was designated Sample No. T-1.

EXAMPLE 2

Using the same solutions as those of Example 1, the same amounts of Solution M and Solution R were continuously and uniformly spouted from nozzles each having the same diameter in a direct current magnetic field (1,000 Oe) and admixed together to start the reaction, and then Solution A (containing chromic acid anhydride in place of potassium chromium sulfate) was spouted from a nozzle having a diameter one-half that of the above-used nozzle in the already mixed black solution to continuously carry out the reaction to obtain a ferromagnetic powder. The thus prepared powder was treated in the same manner as that of the Example 1 to obtain a dry powder. This was designated Sample No. P-2. Next, the powder was processed in the same manner as that of Example 1 to manufacture a video tape. The surface character of the thus obtained tape was extremely good. This was designated Sample No. T-2.

COMPARATIVE EXAMPLE 1

Referring to Example 1, Solution A and Solution M were admixed in a proportion of 1:4 to prepare another Solution M'. 125 parts of the thus prepared Solution M' were put in a non-magnetic container and a direct current magnetic field of 1,000 Oe was imparted to the entire container. Afterwards, 100 parts of Solution R were added thereto over the course of 10 seconds while slowly stirring, to carry out the reaction, and the reaction was completed after 15 minutes. The ferromagnetic powder obtained was treated in the same manner as that of Example 1 to obtain a dry powder. This was designated Sample No. P-3. Next, the thus obtained powder was treated in the same manner as that of Example 1 to manufacture a video tape. The surface character of the obtained tape was good. This was designated Sample No. T-3.

COMPARATIVE EXAMPLE 2

Referring to Example 2, 0.05M/liter of chromic acid anhydride was added to Solution M to prepare another Solution M'', which was used in the following reaction in place of Solution M. In the same manner as that of Example 2 with the exception of Solution A, a dried ferromagnetic powder was obtained. This was designated Sample No. P-4.

In the same manner as that of Example 1, a video tape was manufactured using the above-obtained ferromagnetic powder. The surface character of the obtained tape was good. This was designated Sample No. T-4.

COMPARATIVE EXAMPLE 3

Referring to Comparative Example 1, 100 parts of Solution M'', without the potassium chromium sulfate, were used and otherwise the same treatment was carried out to obtain a ferromagnetic powder, which was designated Sample No. T-5. In the same manner as that of Comparative Example 1, a video tape was manufactured using the ferromagnetic powder obtained. This was designated Sample No. T-5.

The following Table 1 shows the proportion of the components of the respective powder samples and the particle sizes thereof. The Bs value of each sample and that after treatment for 10 days in an atmosphere of a temperature of 60°C and 90% RH are also given therein.

Table 1

| No. | Sample | Bs gauss Initial | Bs gauss After treatment for 10 days at 60°C, 90% RH | Particle Size (A) | Components (%) Fe | B | Co | Cr |
|---|---|---|---|---|---|---|---|---|
| Ex.1 | P-1 | 13,000 | 12,000 | 350 | 72.0 | 5.6 | 7.0 | 4.1 |
| Ex.2 | P-2 | 12,500 | 12,000 | 380 | 72.0 | 5.6 | 7.0 | 3.8 |
| Com. Ex.1 | P-3 | 12,500 | 11,100 | 340 | 72.5 | 5.6 | 7.1 | 4.2 |
| Com. Ex.2 | P-4 | 12,000 | 11,100 | 360 | 72.5 | 5.6 | 7.0 | 4.0 |
| Com. Ex.3 | P-5 | 11,000 | 5,200 | 250 | 72.0 | 5.6 | 7.0 | — |

The characteristics of the respective tapes are shown in the following Table 2.

Table 2

| No. | Sample | Hc(Oe) | Br/Bs | Surface Character | Dispersion of Powder |
|---|---|---|---|---|---|
| Ex.1 | T-1 | 1,000 | 0.86 | Extremely good | Extremely good |
| Ex.2 | T-2 | 970 | 0.87 | Extremely good | Extremely good |
| Com. Ex.1 | T-3 | 650 | 0.83 | Good | Good |
| Com. Ex.2 | T-4 | 600 | 0.83 | Good | Good |
| Com. Ex.3 | T-5 | 1,100 | 0.80 | Ordinary | Ordinary |

As is apparent from the results of the above Examples and Comparative Examples, the ferromagnetic powders of the present invention containing at least Fe and B and coated with a Cr layer have excellent oxidation resistance and are stable to variations of the coercive force, especially to a decrease thereof. In addition, when these substances are used in the formation of magnetic recording tapes, the dispersion and magnetic orientation thereof are excellent, and thus, tapes of a high squareness ratio (Br/Bs) and an excellent surface character can be obtained. These substances are extremely excellent as ferromagnetic powders for high density recording. Although the ferromagnetic powders of the present invention have particle sizes and ingredients almost similar to those of known Cr-containing ferromagnetic powders which are prepared by previously adding Cr to the reaction solution, the latter containing Cr uniformly distributed in the particles, only the present ferromagnetic powders have the above-described advantages, being different from other conventional similar ferromagnetic powders. This is a characteristic feature of the present ferromagnetic powders containing the Cr-component principally in the surface of the particle.

It has been confirmed that the Cr present in the surface of ferromagnetic powders of the present invention may have any form of a Cr-metal per se, a Cr-oxide and a Cr-hydroxide as well as an alloy and a solid solution with the ferromagnetic powder component.

While the invention has been described in detail and with reference to specific embodiments thereof, it will be apparent to one skilled in the art that various changes and modifications can be made therein without departing from the spirit and scope thereof.

What is claimed is:

1. A method for the preparation of a ferromagnetic powder for a magnetic recording medium which contains at least one of Fe—B, Co—B, Fe—Co—B, Fe—Ni—B, Co—Ni—B, or Fe—Co—Ni—B with the surface of the ferromagnetic powder having thereon a layer of Cr or a layer mainly consisting of Cr, the method comprising reducing a metal salt capable of forming a ferromagnetic powder containing at least one of Fe, Co, Fe—Co, Fe—Ni, Co—Ni and Fe—Co—Ni in an aqueous solution thereof with one or more borohydride compounds or derivatives thereof, and, after the reducing is initiated, adding an aqueous solution containing Cr ion or a Cr-containing anion to said reaction solution, the method being conducted under the following conditions:

a. the amount of Cr added to the aqueous solution of the metal salt is about 0.001 to 0.5 mol per 1 mol of metal ion in the aqueous solution of the metal salt;
b. under a pressure of about 0.5 to 5 atmospheres;
c. at a temperature of about −10°C. to about 65°C;
d. the pH of the reaction solution being about 12 or less;
e. the metal ion concentration of the aqueous solution ranging from about 0.002 to 2 moles/liter;
f. the concentration of said borohydride compound or derivative thereof reducing agent being in the range of about 0.002 to 10 moles/liter; and
g. the molar ratio of the borohydride compound or derivative thereof reducing agent to the metal ion being in the range of about 0.1 to 5.

2. The method as claimed in claim 1, wherein said metal salt additionally contains one or more salts of La, Ce, Nd, Sm, Sn, Al, W, Cr, Mn, Cu, Zn, Ag, Pb, Pd and Ti.

3. The method as claimed in claim 1, wherein said metal salt is selected from the group consisting of the sulfates, chlorides, sulfides, nitrates, formates, acetates, pyrophosphates and sulfamates of said metals.

4. The method as claimed in claim 2, wherein said metal salt is selected from the group consisting of the sulfates, chlorides, sulfides, nitrates, formates, acetates, pyrophosphates and sulfamates of said metals.

5. The method as claimed in claim 1, wherein said borohydride compound is selected from the group consisting of sodium borohydride, potassium borohydride, borazane, borane, borohydride, dimethylaminoborane, diethylaminoborane and derivatives thereof.

6. The method as claimed in claim 1, wherein said aqueous solution containing Cr ion or a Cr-containing anion is an aqueous solution of potassium chromium sulfate, chromium nitrate, chromium acetate, chromium chloride, chromic anhydride, a dichromate, chromium sulfate or ammonium chromium sulfate.

7. The method as claimed in claim 6, wherein said Cr-compound is added to the aqueous solution of the metal salt in the presence of hydrogen gas generated after initiation of the reaction.

8. The method as claimed in claim 1, wherein the aqueous solution additionally contains a monocarboxylic acid or a salt thereof; a dicarboxylic acid or a salt thereof; or an oxycarboxylic acid or a salt thereof.

9. The method as claimed in claim 8, wherein the monocarboxylic acid is formic acid, acetic acid, propionic acid, butyric acid, valeric acid, acrylic acid, trimethylacetic acid, benzoic acid or chloroacetic acid, wherein the dicarboxylic acid is oxalic acid, succinic acid, malonic acid, maleic acid, itaconic acid or p-phthalic acid and wherein the oxycarboxylic acid is glycolic acid, lactic acid, salicylic acid, tartaric acid, or citric acid.

10. The method as claimed in claim 1, wherein the aqueous solution further contains boric acid, carbonic acid, sulfurous acid, hydrochloric acid, sulfuric acid, phosphoric acid, nitric acid, ammonium hydroxide or an alkali metal hyroxide.

11. The method as claimed in claim 1, wherein the aqueous solution contains a soluble protein, a carbohydrate or an organic solvent with or without a proteolytic enzyme and/or a carbohydrate decomposer.

12. The method as claimed in claim 1, wherein the reducing is carried out in the presence of ultrasonic waves.

13. The method as claimed in claim 1, wherein the reducing is carried out in a magnetic field of a strength of several tens of Oe or more.

14. The method as claimed in claim 13, wherein the strength of the magnetic field is about 500 to 3,000 Oe.

15. The method as claimed in claim 1, wherein the metal ion concentration is 0.01 to 0.5 mole/liter.

16. The method as claimed in claim 1, including heating the formed ferromagnetic powder substance in a non-oxidizing atmosphere or in the presence of a slight amount of $H_2O$ or $O_2$.

17. The method as claimed in claim 1, wherein the layer of Cr or the layer mainly consisting of Cr is about 0.1 micron or less in thickness.

18. The method as claimed in claim 1, wherein said layer of Cr or said layer mainly consisting of Cr contains at least 1% by weight of Cr.

19. A ferromagnetic powder comprising the product produced by the method of claim 1.

* * * * *